US007683281B2

(12) United States Patent
Bresciani et al.

(10) Patent No.: US 7,683,281 B2
(45) **Date of Patent: *Mar. 23, 2010**

(54) CIRCUIT BREAKER WITH SUSPENDED MOBILE CONTACT ASSEMBLY

(75) Inventors: Nicola Bresciani, Bergamo (IT); Luigi Bonetti, Bergamo (IT)

(73) Assignee: ABB S.p.A., Milan (IT)

( * ) Notice: Subject to any disclaimer, the term of this patent is extended or adjusted under 35 U.S.C. 154(b) by 201 days.

This patent is subject to a terminal disclaimer.

(21) Appl. No.: 11/913,861

(22) PCT Filed: May 3, 2006

(86) PCT No.: PCT/EP2006/062024

§ 371 (c)(1),
(2), (4) Date: Nov. 8, 2007

(87) PCT Pub. No.: WO2006/120149

PCT Pub. Date: Nov. 16, 2006

(65) Prior Publication Data

US 2008/0185280 A1 Aug. 7, 2008

(30) Foreign Application Priority Data

May 13, 2005 (IT) ..... BG2005A0026

(51) Int. Cl.
*H01H 5/00* (2006.01)

(52) U.S. Cl. ..... 200/400; 200/244

(58) Field of Classification Search ..... 200/400, 200/17 R, 329, 335, 339, 244
See application file for complete search history.

(56) References Cited

U.S. PATENT DOCUMENTS

| | | | | |
|---|---|---|---|---|
| 5,025,236 | A | 6/1991 | Miura et al. | |
| 5,479,143 | A | 12/1995 | Payet-Burin et al. | |
| 5,539,167 | A * | 7/1996 | Hood et al. | 200/244 |
| 2004/0256207 | A1 | 12/2004 | Azzola et al. | |

FOREIGN PATENT DOCUMENTS

| | | |
|---|---|---|
| EP | 0 490 332 | 6/1992 |
| GB | 2 006 527 | 5/1979 |

* cited by examiner

*Primary Examiner*—Edwin A. Leon
*Assistant Examiner*—Vanessa Girardi
(74) *Attorney, Agent, or Firm*—Connolly Bove Lodge & Hutz LLP

(57) ABSTRACT

The present invention relates to an automatic switch (1) to be used preferably in low-voltage systems. The automatic switch (1) comprises an outer casing (2) containing for each pole at least one fixed contact (10) and at least one mobile contact (20) housed in a corresponding seat (25) provided on a mobile element (50) operatively connected to a control mechanism (60) to enable its movement. The automatic switch (1) according to the invention comprises means for the support of the mobile element (50), which are constrained to a structural part (70) of the control mechanism (60). Said supporting means support the mobile element (50) through hinge connection means to provide a center of rotation for the mobile element itself.

21 Claims, 11 Drawing Sheets

CIRCUIT BREAKER WITH SUSPENDED MOBILE CONTACT ASSEMBLY

RELATED APPLICATIONS

This application is a national stage application (under 35 U.S.C. § 371) of PCT/EP2006/062024 filed May 3, 2006, which claims benefit of Italian application BG2005A000026 filed May 13, 2005, disclosure of which are incorporated herein by reference.

The present invention relates to a switch comprising a suspended mobile element to be used preferably in low-voltage systems.

It is known that automatic switches and disconnectors comprise one or more electrical poles, associated to each of which are at least one fixed contact and at least one mobile contact, which can be coupled to/uncoupled from one another. Automatic switches according to the known art also comprise control means that enable movement of the mobile contacts, thus bringing about their coupling to or uncoupling from the corresponding fixed contacts.

The action of said control means occurs traditionally on a main shaft that is operatively connected to the mobile contacts so that, following upon its rotation, the mobile contacts are moved from a first operating position to a second operating position, which are respectively characteristic of an open configuration of the switch and a closed configuration thereof.

In the case of switches for low currents (indicatively of up to 800 A) and with somewhat limited breaking capacities, there exist solutions that bring the main shaft to coincide with the mobile contacts, giving rise to a rotating mobile element capable of guaranteeing insulation between the phases and of course correct transmission of the movements and of the forces involved. The mobile element is usually supported by structural parts of the box for containing the switch, which basically form bearing areas with the mobile element itself.

As the currents involved increase, an increasing performance of mechanical tightness is required from the mobile element given the same dielectric characteristics, which must in any case be preserved and guaranteed.

From the practical standpoint, the requirement of better mechanical characteristics results in an increase in the radial dimensions of the mobile element, with a consequent increase in the friction that is created in said areas of bearing. This of course adversely affects the performance of the apparatus and tends to reduce the duration of the switch and of its parts, with progressive degradation of the overall mechanical efficiency.

To overcome the above drawback, metal reinforcement shafts have been used, which pass through the mobile element, so enabling rated currents of 800 A to be exceeded in certain configurations. These shafts, however, may interfere with the characteristics of electrical insulation between the poles and are hence far from advantageous inasmuch as their use is extremely critical. In practice, the aspects mentioned above lead to a preference for the use of the mobile element only in switches for low currents.

There consequently exists the need to extend the use of the mobile element also in those switches designed for providing high performance in terms of rated currents and of breaking capacity in order to create more compact assembly structures that can be readily assembled and made up of a limited number of components.

On the basis of these considerations, the main task forming the subject of the present invention is to provide a switch that will enable the limits and drawbacks referred to above to be overcome.

In the framework of this task, a purpose of the present invention is to provide a switch that has a structure that is compact, can be easily assembled, and is made up of a limited number of components.

Another task forming the subject of the present invention is to provide a switch in which the friction between the different parts making up the switch will be extremely limited and compatible with high performance and long service life.

A further purpose of the present invention is to provide a switch that will present a high reliability, will be easy to manufacture, and afford competitive costs.

The above task, as well as the above and other purposes that will emerge more clearly from what follows, is achieved through a switch comprising:

- an outer casing containing for each pole at least one fixed contact and at least one mobile contact, which can be coupled to/uncoupled from one another; and
- a mobile element, defined by a shaped body comprising at least one seat for each pole of said switch, each seat being designed to house at least one mobile contact of the corresponding pole.

The switch according to the invention is characterized in that it comprises:

- a control mechanism, operatively connected to the mobile element to enable its movement, said control mechanism comprising mechanical means, supported by a structural part connected to the outer casing; and
- supporting means, constrained to the structural part of said control and operatively connected to the mobile element through hinge connection means to provide a centre of rotation for the mobile element itself.

The switch according to the invention is distinguished by radial dimensions of the mobile element that are freely expandable owing to the presence of supporting means that provide the mobile element itself with a centre of rotation and a rotation pin, limiting the areas of bearing necessary for its support and its rotation. Said supporting means are moreover directly constrained only to the structure of the control mechanism, a fact that facilitates considerably the operations of assembly and maintenance of the switch.

Further characteristics and advantages of the invention will emerge more clearly from the description of preferred but non-exclusive embodiments of the switch according to the invention, illustrated by way of example in the attached plate of drawings, wherein.

Figure 2:
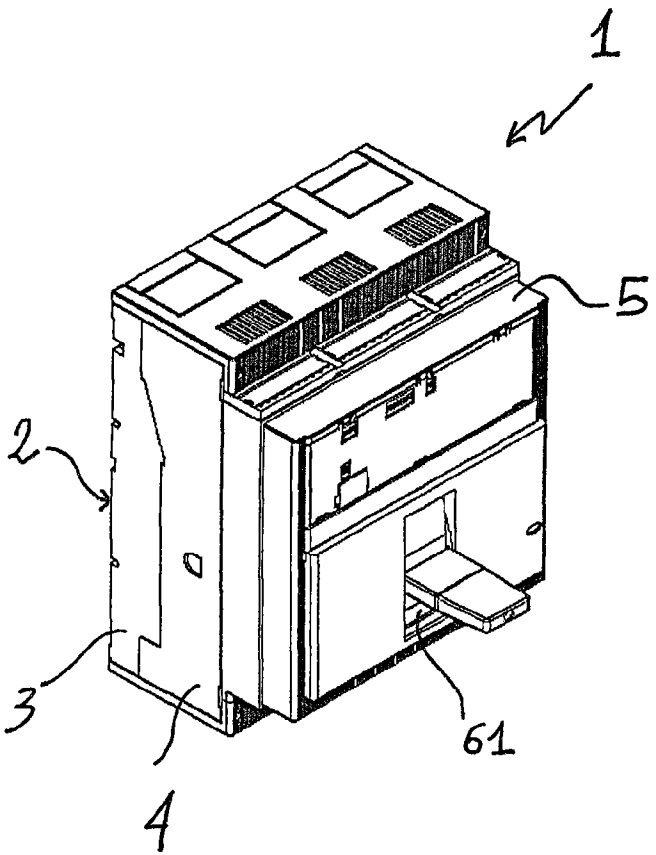
FIG. 2 is a first perspective view of a switch according to the invention comprising a direct control mechanism.

With reference to the above figures, the switch 1 according to the invention comprises an outer casing 2 containing one or more electrical poles, each defined by at least one fixed contact 10 that is coupled to/unccoupled from at least one mobile contact 20. The outer casing 2 also houses a mobile element 50, constituted by a shaped body made of insulating material, preferably a thermosetting resin, which comprises at least one seat 25 for each pole of the switch 1. Operatively connected to the mobile element 50 is a control mechanism, basically constituted by mechanical means supported by a structural part 70 stably connected to the outer casing 2, for instance through the use of tie-rods 62, as specified in greater detail hereinafter.

Figure 1:
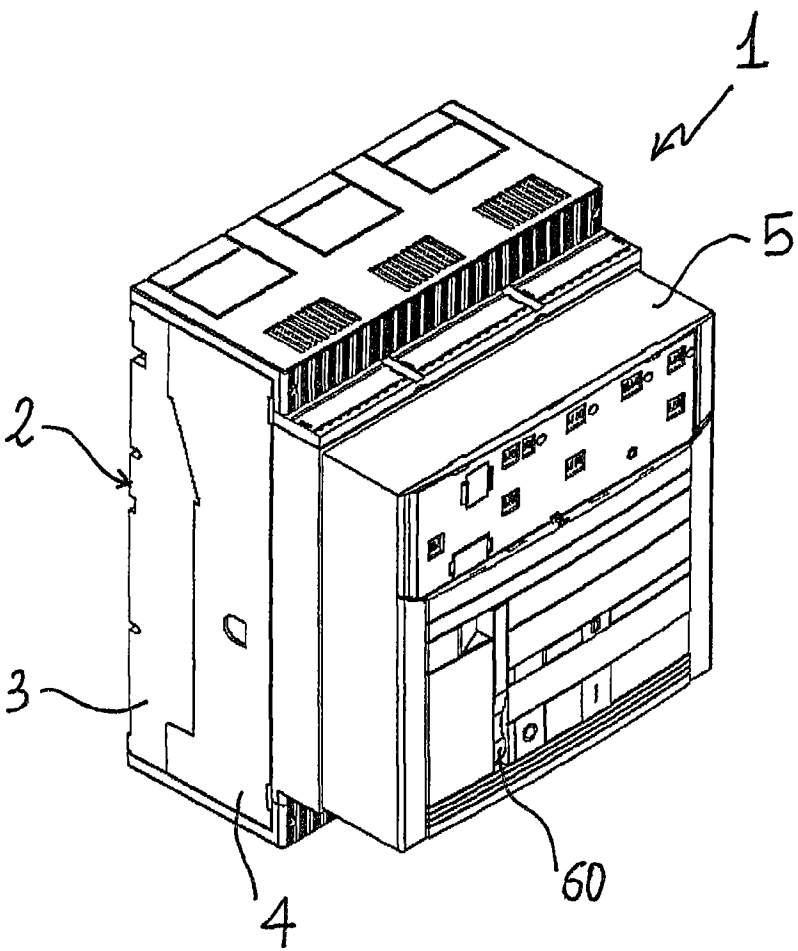
FIG. 1 is a first perspective view of a first embodiment of a switch according to the invention, comprising an energy-accumulation control mechanism.

With reference to FIG. 1, the switch 1 comprises an energy-accumulation control mechanism 60, normally used in applications that envisage high values of rated current and/or of breaking capacity. Alternatively, said control mechanism can be replaced also by a control mechanism of a direct type 61 (represented in FIG. 2), which is particularly suited for lower rated currents and/or lower breaking capacities.

The switch 1 according to the invention is characterized in that it comprises supporting means constrained to the structural part 70 of the control 60 and at the same time connected to the mobile element 50 through hinge connection means. As will emerge clearly from the sequel of the description, the supporting means support the mobile element 50 with respect to the outer casing 2, preventing the formation of further areas of contact which, as mentioned above, are a source of disadvantageous phenomena of friction. The supporting means at the same time also provide a centre of rotation for the mobile element itself and perform a function of bearings. This solution appears completely different from certain traditional solutions, in which the containing casing is used as supporting means for the mobile element, or else as compared to other solutions, in which particular supports are used that surround the mobile element, giving rise, however, to extensive areas of relative contact.

Figure 4:
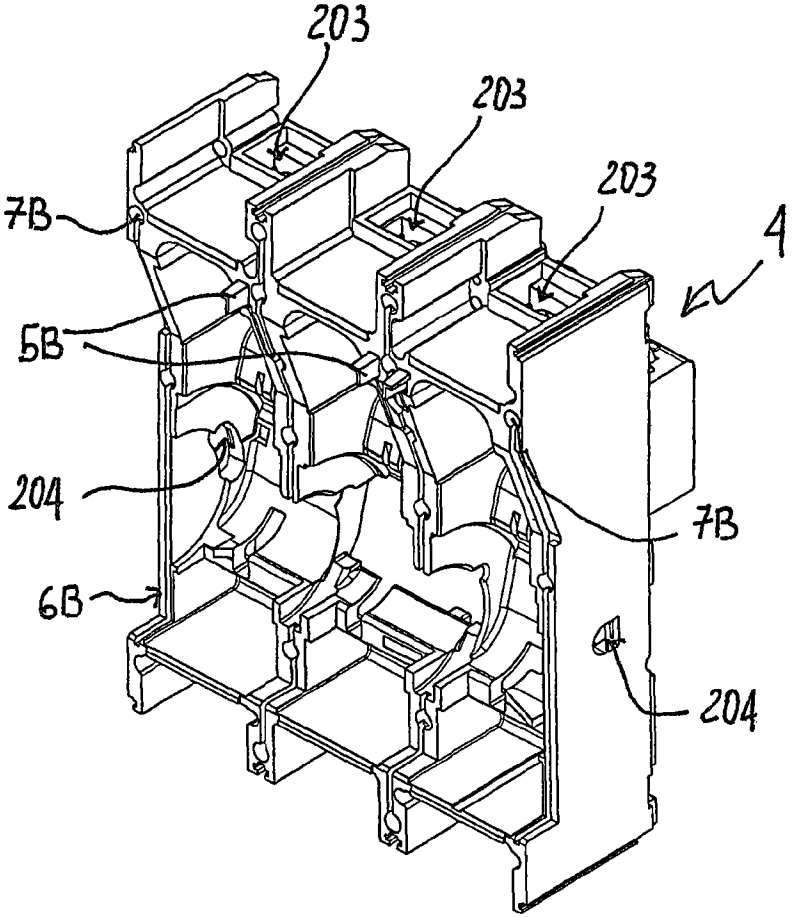
FIGS. 3 and 4 are first perspective views of a possible embodiment of components of an outer casing of a switch according to the invention.
Figure 3:
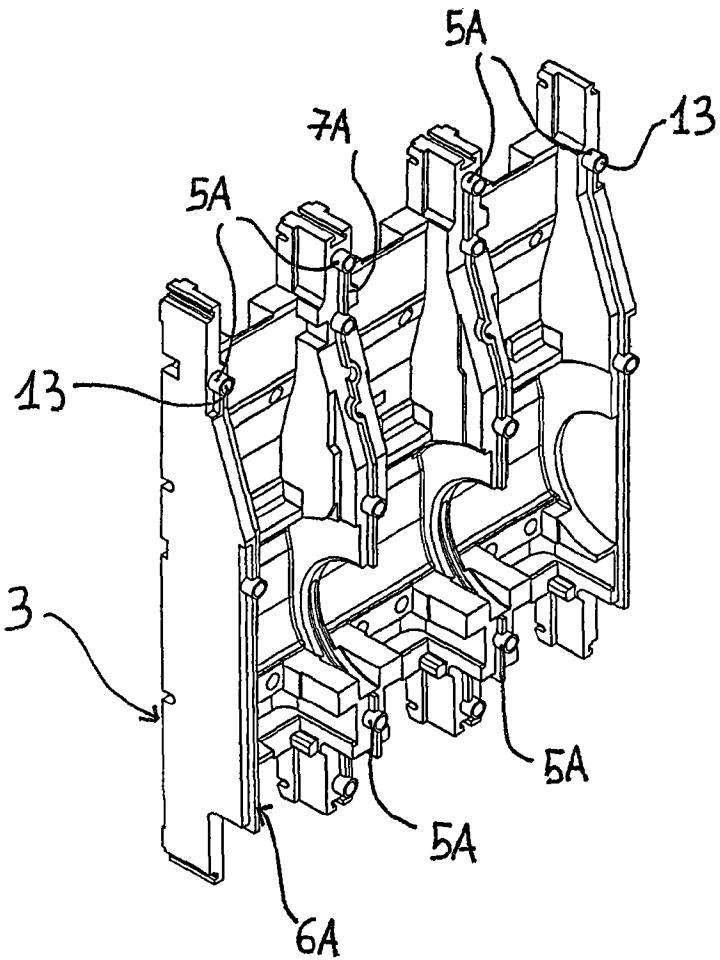

With reference to FIGS. 3 and 4, the outer casing 2 is preferably constituted by a bottom 3, which is coupled to a lid 4 so as to generate spaces, within which the components of the switch 1 that are strictly electrical are housed. In particular, the bottom 3 comprises a first coupling surface 6*a*, from which there emerges a series of protrusions 5*a* designed to be inserted in cavities 7*b* provided on a second coupling surface 6*b* of the lid 4. Likewise, also from this second surface 6*b* there emerge other protrusions 5*b*, which can be inserted into corresponding cavities 7*a* provided on the first coupling surface 6*a*. Basically, the two coupling surfaces 6*a* and 6*b* have a shape that is at least in part geometrically conjugate or complementary, which enables a co-penetration of certain of the parts making up the casing 2.

Figure 6:
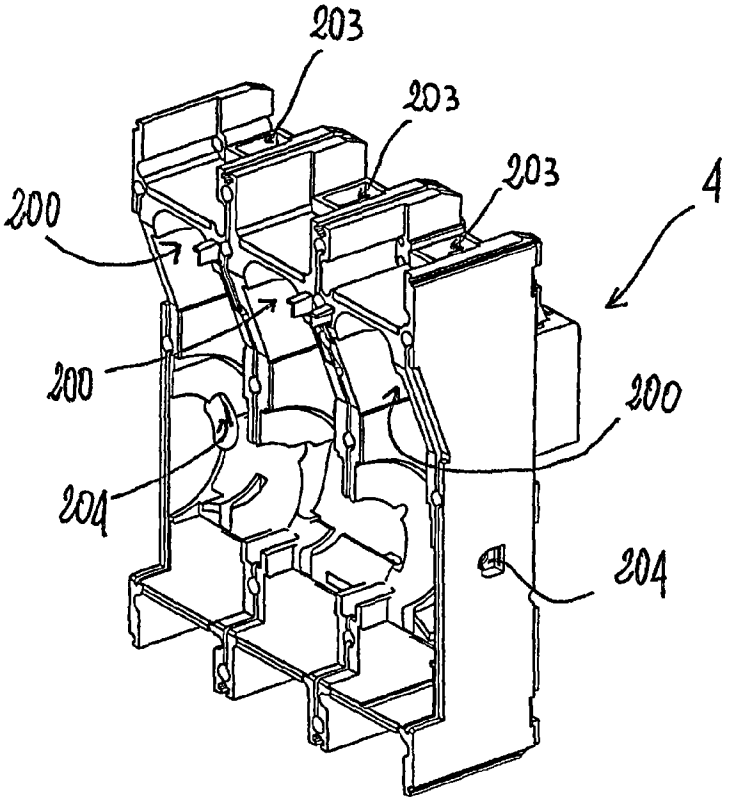
FIGS. 5 and 6 are second perspective views of the components of an outer casing illustrated in FIGS. 3 and 4.
Figure 5:
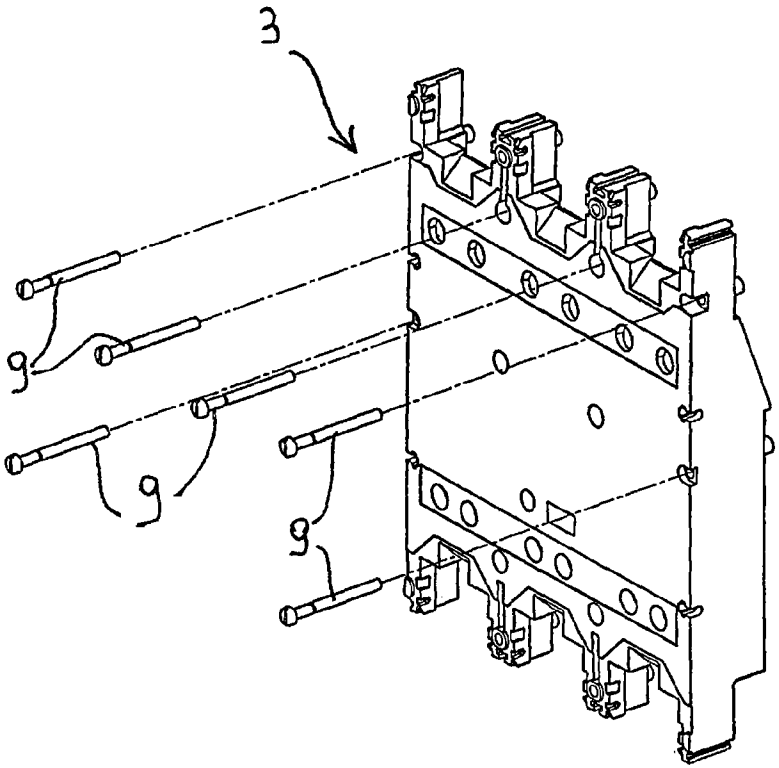

With reference to FIGS. 5 and 6, the tightness of the coupling is moreover ensured by a series of fastening screws 9, which ensure an adequate resistance of the casing 2 against the stresses to which it is subjected during normal operation of the switch 1. As illustrated, the fastening screws 9 are inserted into holes 13, which are made both on the bottom 3 and on the lid 4, and can alternatively be replaced by other functionally equivalent means, such as for example bolts or tie-rods.

Alternatively, the outer casing can be made of sheet metal, as commonly occurs in switches of the so-called "open" or "air circuit breaker" (ACB) type.

Figure 9:
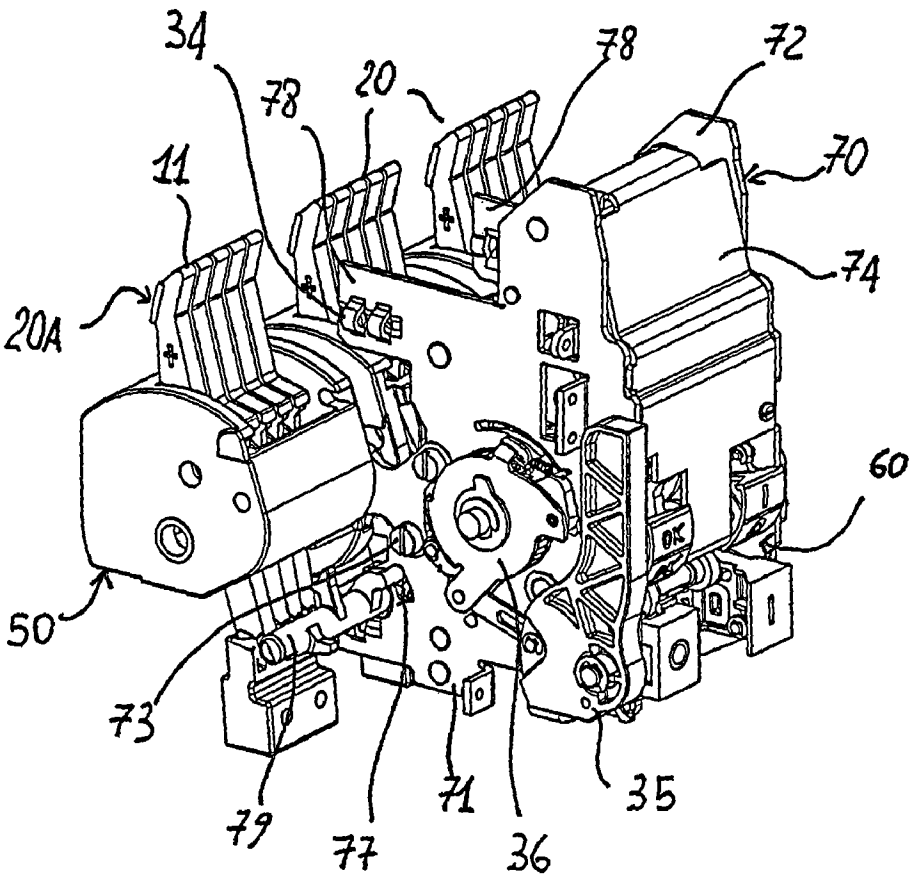
FIG. 9 is a first exploded view of components of the switch according to the invention represented in FIG. 1.
Figure 9:
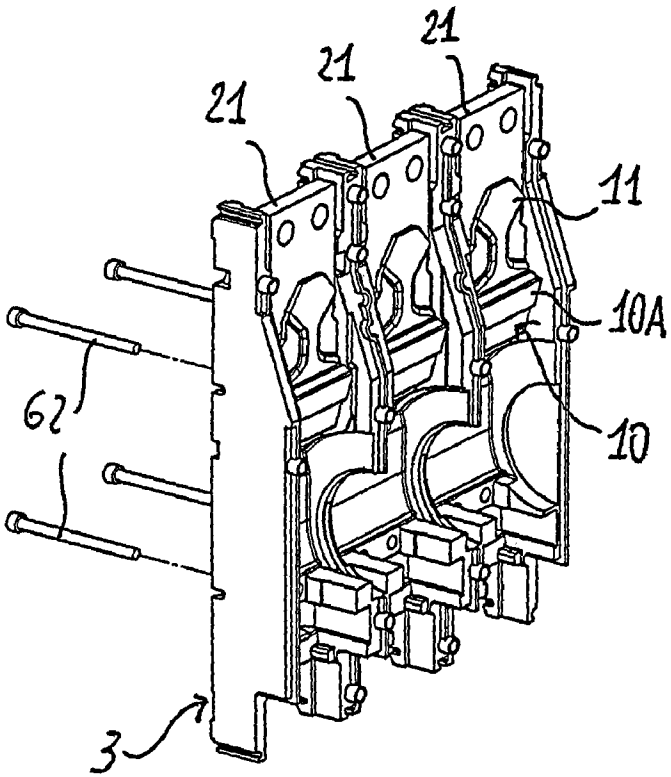

FIG. 9 provides a clearer view of the inner side of the bottom 3 of the containing casing 2, on which the fixed contacts 10 are pre-arranged, each electrically connected to an electrode 21. The fixed contacts 10 illustrated each comprise an active part 10*a*, which comes into contact with a corresponding active part 20*a* provided on the mobile contacts 20. Both the fixed contacts 10 and the mobile ones 20 can advantageously comprise an arc chute 11 that has the function of deviating the electric arc in order to limit the degradation of the active parts of the contacts themselves.

In the case of use of metal outer casings, insulating elements will be set between the fixed contacts and the casing itself, as in the known art.

With reference to FIGS. 4 and 6, the lid 4 can be advantageously made of insulating material to improve the electrical insulation between the metal parts making up the switch. Since the lid 4 is coupled to the bottom 3, it generates at least one arc chamber 200 for each pole of the switch. Preferably housed within each arc chamber are breaking elements that have the function of facilitating extinction of the arc that is generated following upon separation of the contacts of the switch 1. Each arc chamber 200 comprises at least one top opening 203, which constitutes the outlet for discharge of the gases that are generated following upon creation of the electric arc. The lid 4 also has side openings 204, which enable an operator to gain access to the mobile element 50 in order, for example, to place or remove the means of connection between/from between the control mechanism 60 and the mobile element 50 and/or to enable passage of shafts or bars for signalling the state (for example open, closed, tripped).

With reference once again to FIGS. 1 and 2, the containing casing 2 can be advantageously completed with a protective mask 5, which is applied to the lid 4 and can, if necessary, be easily removed by an operator to enable access to the internal parts of the switch 1.

Figure 7:
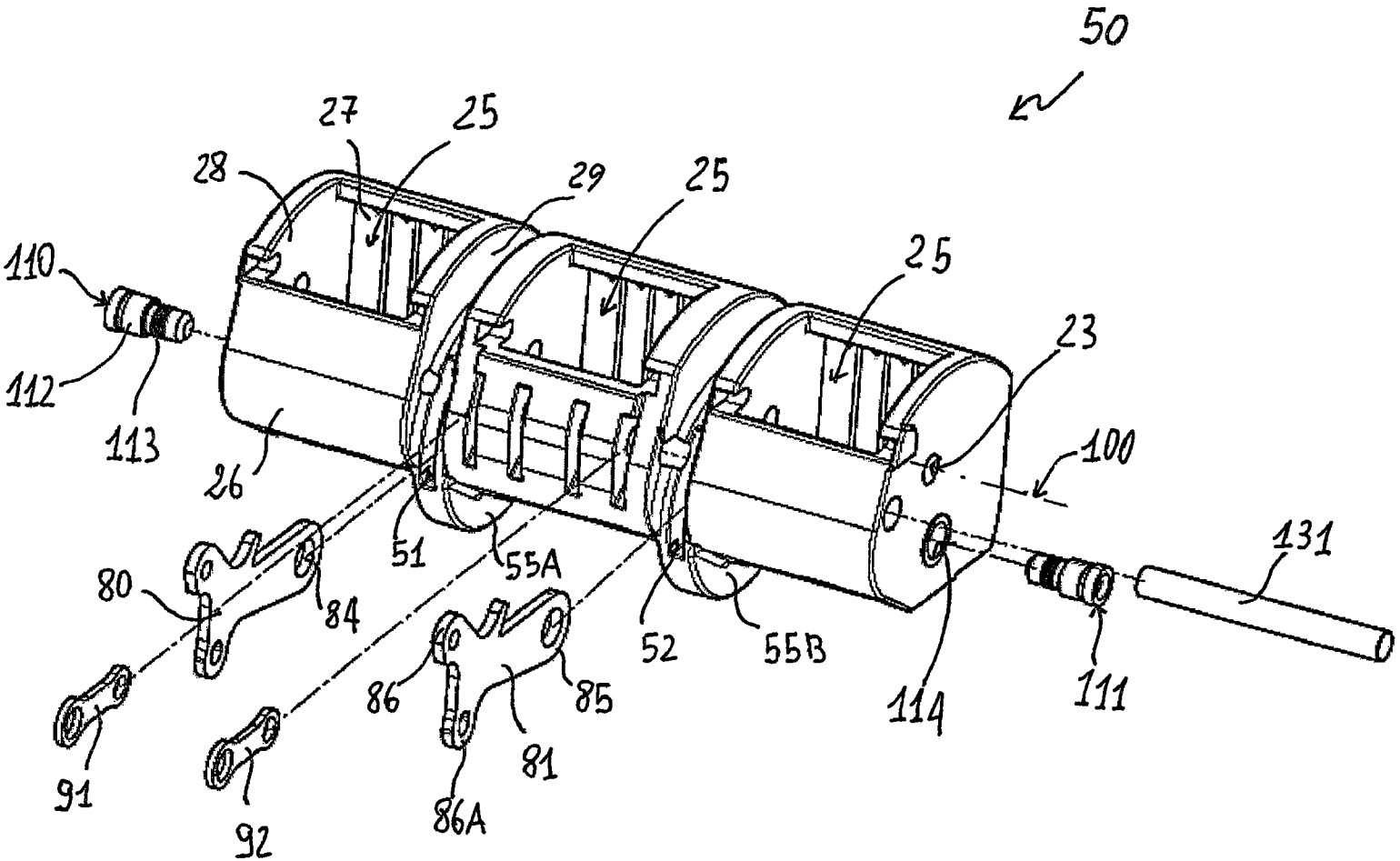
FIGS. 7 and 8 are perspective views of a possible embodiment of a mobile element and of supporting means of a switch according to the invention.
Figure 8:
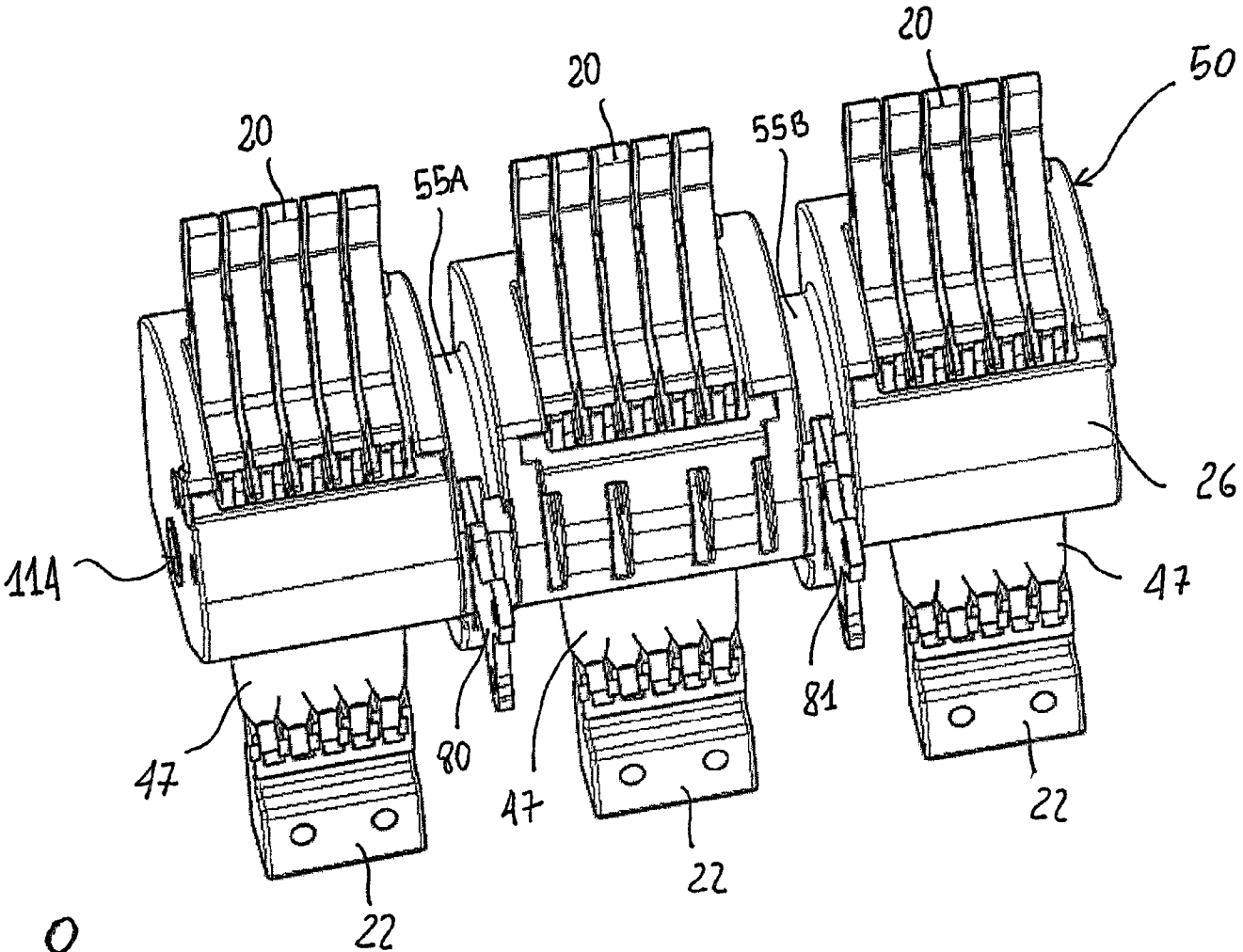

FIGS. 7 and 8 regard a possible embodiment of a mobile element 50 according to the invention and more in particular a mobile element for a three-pole switch. This does not rule out the possibility of the technical solutions presented hereinafter being used also for switches having a different number of poles. With reference now to FIG. 7, the mobile element 50 is defined by a shaped body comprising a seat 25 for each pole of the switch 1. Housed in each seat 25 is a mobile contact 20, which can be made of a single piece or else of a plurality of mutually adjacent components, as clearly illustrated in FIG. 8. These seats 25 are made so as to be mutually adjacent and are particularly arranged so that the mobile contacts 20 housed therein will have a common axis of rotation 100 with respect to the mobile element itself. The latter is physically constituted by transverse rotation pins arranged on appropriate housings 23 obtained in each of the seats 25.

In a preferred embodiment thereof, the seats 25 are defined basically by a front wall 26, a rear wall 27, substantially opposite to the front one 26, by a first side wall 28 and a second side wall 29, which are substantially opposite to one another. These walls are mutually arranged in such a way as to generate at least one first opening and one second opening, from which there come out, respectively, the corresponding mobile contact 20 and means of electrical junction 47 (see FIG. 8). The latter, constituted for instance by a copper braid, connect the mobile contact 20 electrically to an electrode 22, which is in turn connected to the electrical network where the switch 1 is inserted. In the case where the switch 1 functions according to the known principle of double interruption, there may advantageously come out from the second opening other electrical contacts designed to couple with a further series of fixed contacts altogether similar to the ones referred to above.

The mobile element 50 comprises connecting parts 55*a* and 55*b*, which are substantially circular, located between two adjacent seats 25. In the solution illustrated in FIGS. 7 and 8, these circular connecting parts 55*a* and 55*b* emerge for a portion thereof with respect to the space occupied by the seats 25. This solution is to be considered merely as a possible embodiment, and absolutely not an exclusive one, of the mobile element.

Each of these connecting parts 55 comprises at least one radial recess for connection of the mobile element 50 to the supporting means, as described in what follows. More precisely the mobile element 50 illustrated in FIGS. 7 and 8 comprises a first connecting part 55*a* and a second connecting part 55*b*, comprising a first radial recess 51 and a second radial recess 52, respectively.

In a possible embodiment illustrated once again in FIG. 7, the supporting means are constituted by at least one first supporting arm 80 and one second supporting arm 81 having at least two mutually opposed ends. In particular, each of said arms comprises at least one first operative end 85 that is connected to the mobile element 50 and one second retention end 86 that is constrained to the structural part 70 of the control mechanism 60 and 61. According to a preferred embodiment, the two supporting arms 80 and 81 have a "three-lobed" configuration, comprising a third retention end 86*a* adjacent to the aforesaid second end 86.

FIG. 9 is an exploded view of a first embodiment of the switch 1 according to the invention, equipped with an energy-accumulation control mechanism 60. The structural part 70 of the mechanism 60 basically comprises a first side 71 and a second side 72, set between which are the mechanical means necessary for movement of the mobile element 50. Set between these sides 71 and 72 is a transverse wall 74, which has the purpose of increasing the mechanical rigidity of the control 60. Located at the side of this transverse wall 74 is a loading lever 35, which instead has the function of actuating a device 36 for loading the springs of the mechanical means.

In the solution illustrated, the first side 71 also comprises a side opening 77 provided for enabling the members 79 for signalling the state of the switch 1 (for example, open, closed, tripped) to come out.

As illustrated in FIG. 9, the supporting arms 80 and 81 are preferably constrained to the control mechanism 60 on the outer side of each side 71 and 72 through the use of removable fixing means 73, for instance screws or alternatively rivets. In a further arrangement, the supporting arms 80 and 81 could also be made of a single body with the sides 71 and 72, without the use of fixing means.

The structural part 70 of the control mechanism 60 comprises fastening protrusions 78, which enable fixing of the control itself to the containment casing 2 of the switch 1 and in particular to the bottom 3. As already mentioned, fixing is obtained preferably by means of a plurality of tie-rods 62, which are inserted in through holes 83 made in the bottom 3 of the outer casing 2 and then screwed in threaded cavities 34 provided on the fastening protrusions 78. It is evident that said connection renders the mobile element 50 substantially suspended in cantilever fashion with respect to the casing 2, and for said purpose the "three-lobed" shape of the supporting arms 80 and 81 is particularly advantageous in so far as it enables a greater resistance to bending and hence a more stable positioning of the mobile element itself.

As already referred to above, the supporting arms 80 and 81 provide the centre of rotation of the mobile element 50 through a hinge connection. The latter is obtained within said radial recesses 51 and 52, pre-arranged in the connecting parts 55*a* and 55*b* of the mobile element 50. With reference in particular to FIG. 7, the hinge connection means comprise, for each supporting arm 80 and 81, a rotation pin 110 and 111, which is inserted in a first hole 84 made on the first operative end 85 and in a second hole provided on the mobile element 50.

Figure 14:
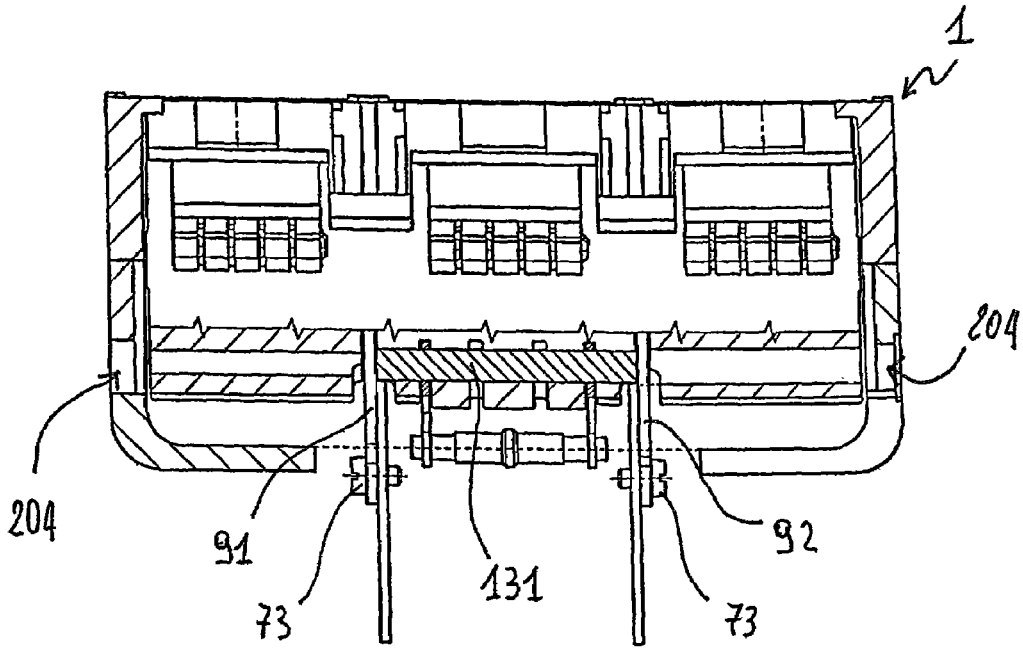
FIG. 14 is a schematic cross-sectional view of a possible form of connection between the supporting means and the mobile element of a switch according to the invention.

FIG. 7 and FIG. 14 illustrate a preferred embodiment of these rotation pins 110 and 111, which have at least one first calibrated longitudinal portion 112 that is coupled to the internal surface of the first hole 84 made on the corresponding supporting arm 80 or 81. Each pin advantageously also comprises a second retention portion 113, which is constrained by friction or by screwing in the second hole of the mobile element 50. In practice, the second portion 113 enables positioning of the pin with respect to the mobile element 50, whilst the calibrated portion 112 enables rotation of the mobile element itself with respect to the supporting arms 80 and 81 supporting it. From the standpoint of assembly, the solution described is extremely advantageous in so far as each rotation pin has contained axial dimensions that facilitate its positioning within the mobile element 50 in a position corresponding to the radial recesses 51 and 52.

FIG. 14 illustrates a cross-sectional view of the connection in question and enables appreciation of the advantages of this solution. The rotation pins are located in their operative positions, exploiting gaps 114 made on the side walls of the housing seats 25. The contained axial dimension of the rotation pins 110 and 111 advantageously also improves the mechanical reliability of the connection.

Alternatively, the two pins 110 and 111 could also be replaced by a single transverse pin that reaches both of the radial recesses 51 and 52 once it is inserted in the mobile element 50.

Figure 15:
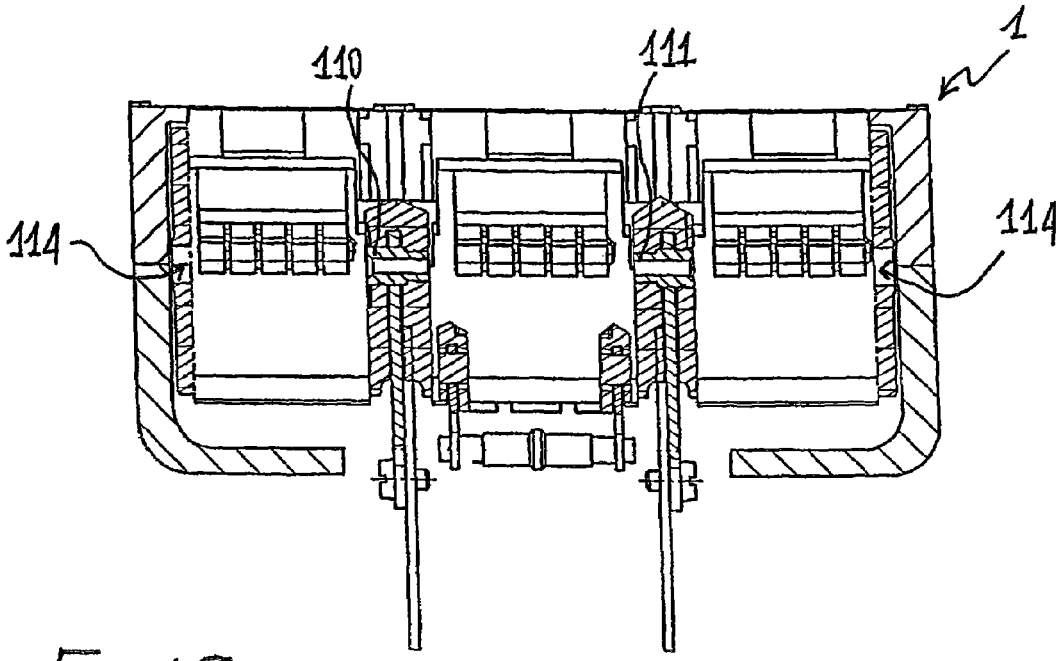
FIG. 15 is a schematic cross-sectional view of a possible form of connection between a control mechanism and the mobile element of a switch according to the invention.

FIGS. 7, 9 and 15 enable appreciation of a possible mode of connection between the control mechanism 60 and the mobile element 50. In particular, the control mechanism 60 comprises a first connecting rod 91 and a second connecting rod 92, which are operatively connected to the mobile element 50 through a common transverse driving pin 131. The connection rods 91 and 92 are inserted in hollow sectors 57 obtained on the front walls of the seats 25 of the mobile element 50 and perforated transversely for housing the driving pin 131. With reference in particular to FIG. 7, these hollow sectors 57 are made on the mobile element 50 substantially on the same side on which the radial recesses 51 and 52 used for connection of the supporting arms 80 and 81 are provided. The presence of a plurality of hollow sectors 57 is particularly advantageous in so far as it enables positioning of the connection rods 91 and 92 at variable distances according to the type of control that is used. As an alternative to the hollow sectors 57, perforated radial protrusions could be provided for insertion of the driving pin 131. The latter, however, must in any case be arranged in a position that is eccentric with respect to the axis of rotation of the mobile element 50 provided by the aforesaid rotation pins 100 and 101 coupled to the supporting arms 80 and 81. In this way, following upon a displacement of the driving pin 131 a torque is generated that drives the mobile element 50 and consequently the mobile contacts 20 in rotation.

Figure 10:
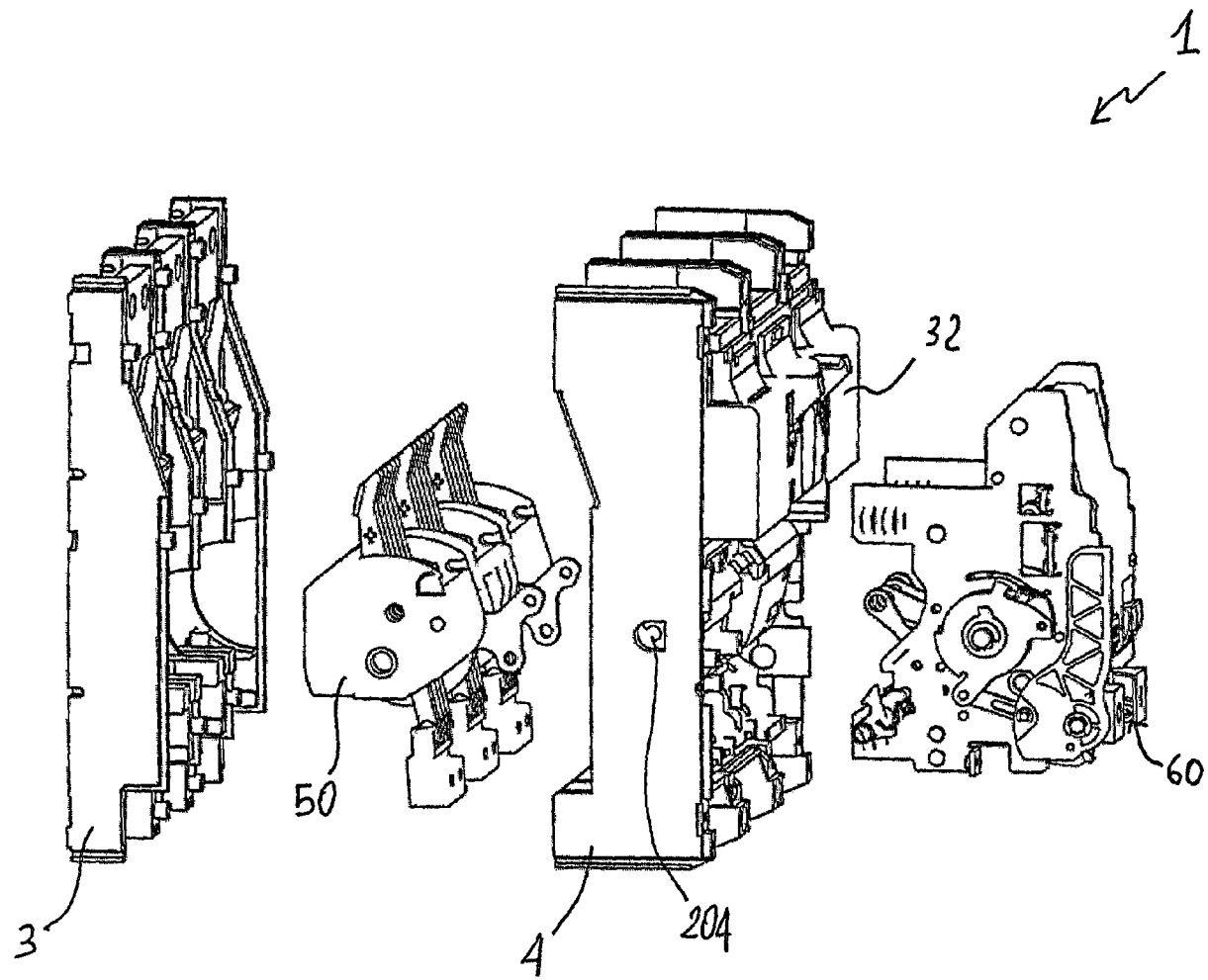
FIG. 10 is a second exploded view of the switch represented in FIG. 1.

FIG. 10 is a second exploded view of a switch 1 according to the invention, from which the modalities with which it can be assembled may be noted.

An initial step envisages the assembly of the supporting arms 80 and 81 to the mobile element 50, which follows placing of the mobile contacts 20 in the seats 25. The mobile contacts 20 are in this step preferably already connected to the corresponding electrodes 22 through the aforesaid electrical-junction means 21. Next, the mobile element 50 is placed within the outer casing 2 generated by the coupling between the bottom 3 and the lid 4, and is then connected to the control mechanism 60. In particular, the connection rods 91 and 92 of the kinematic means are fixed to the mobile element 50 in a position corresponding to the hollow sectors 57 thereof and through the use of the transverse pin 131. The supporting arms 80 and 81 are then fixed to the sides 71 and 72 of the structure 70 of the control 60 through the removable fixing means 73 in a position corresponding to the retention ends 86 and 86*a* provided on the arms themselves. The control 60 is then located in the correct operating position by means of the use of the axial tie-rods 62 that connect it stably to the bottom 3. The sides 71 and 72 of the control 60 are shaped in such a way as to mate with the rear wall 32 of the lid, which functions in practice as spacer between the control itself and the bottom 3. In this way, also the mobile element 50 suspended to the control 60 is placed in a correct operating position. The presence of the lid 4 made of insulating material contributes also to improving insulation of the control from the electrical parts.

In the case of a casing made of sheet metal, such as for example in the typical construction of an air circuit breaker (ACB), the sides of the structure of the control may be shaped so as to mate directly with the bottom of the outer casing.

Figure 11:
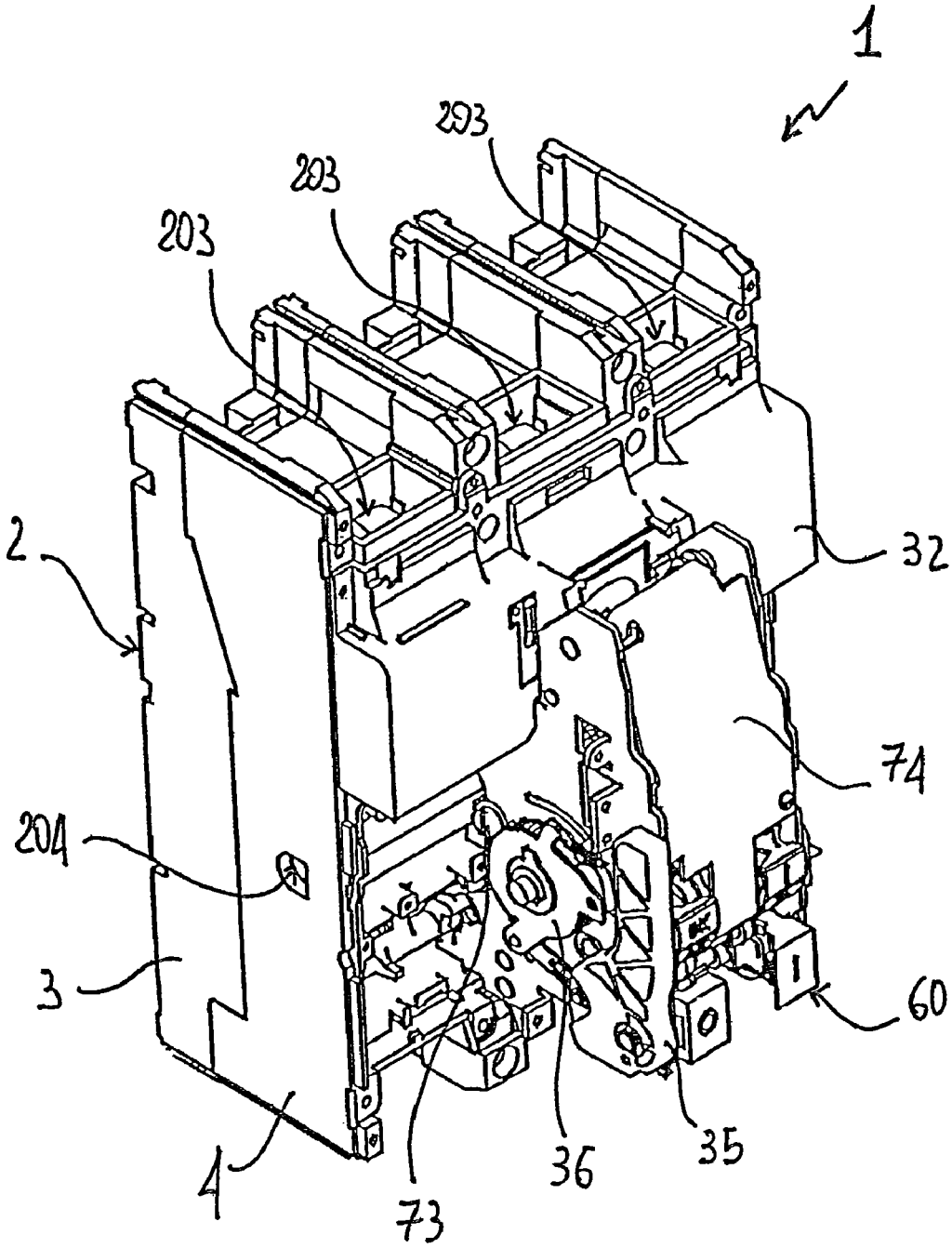
FIG. 11 is a second perspective view of the switch represented in FIG. 1.

FIG. 11 illustrates the switch 1 at the end of the main steps of assembly just described. In particular, it enables appreciation of the side opening 204 made on the side 31 of the lid 4, which allows access within the lid itself to enable placing or removal of the transverse driving pin 131 that connects the control 60 to the mobile element 50. This solution basically enables removal of the control 60 from the switch 1 without disconnecting the two walls making up the casing 2, with obvious advantages from the practical standpoint.

Figure 12:
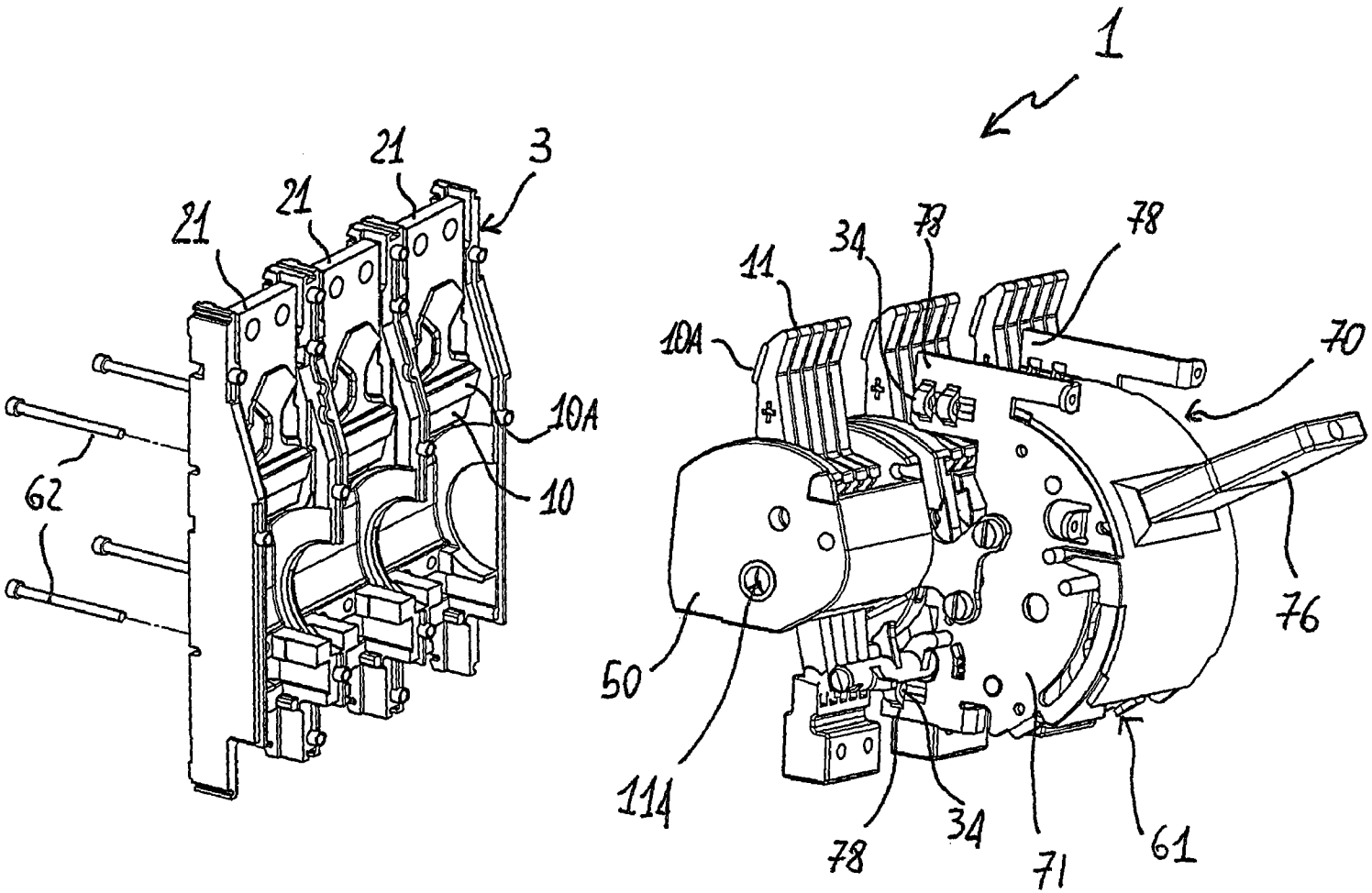
FIG. 12 is an exploded view of the switch according to the invention represented in FIG. 2.

FIG. 12 is an exploded view of a second embodiment of a switch 1 according to the invention, comprising a control of a direct type 61. Unlike the energy-accumulation control 60, the direct control 61 is used for lower values of current and/or breaking capacity and comprises a control lever 76 for closing, opening or resetting of the switch 1 by an operator. The direct control 61, albeit having a different structural configuration, is suited to being advantageously connected to the bottom 3 of the casing 2 according to the same modalities referred to above.

Figure 13:
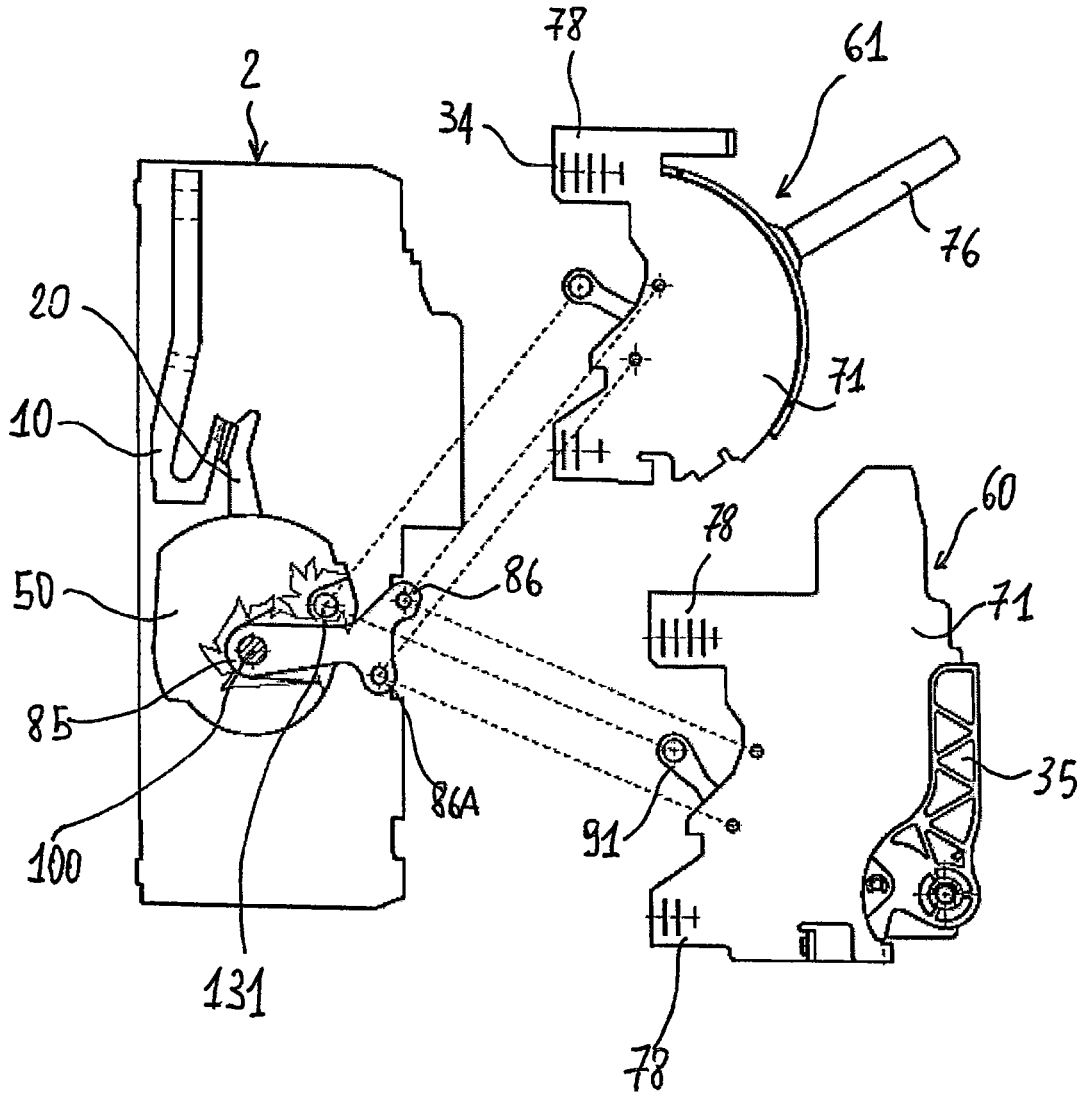
FIG. 13 is a schematic view of a switch according to the invention comprising interchangeable control mechanisms.

From what has just been said, it may therefore be understood that another advantage of the switch 1 according to the invention is represented by the fact that it is structurally configured in such a way as to enable convenient replacement of a control mechanism with one having a different construction and performance, as schematically illustrated in FIG. 13. A control mechanism of a direct type 61 can hence be easily replaced with an energy-accumulation control mechanism 60 by simply pulling out the driving pin 131, separating the supporting arms 80 and 81 from the sides 71 and 72 of the control mechanism 60 and releasing the latter from the bottom 3 of the casing 2 by removing the tie-rods 62. In this way, one and the same switch 1 can be used in different applications, thus demonstrating a considerable functional flexibility.

The technical solutions adopted for the switch according to the invention, thus enable the pre-set tasks and purposes to be fully achieved. The switch has a compact internal structure, which can be easily assembled and is made up of a limited number of components. The use of supporting means enables limitation of the areas of friction, thus improving the mechanical efficiency of the switch.

The switch thus conceived may undergo numerous modifications and variations, all of which falling within the scope of the inventive idea; moreover, all of the items may be constituted by other technically equivalent ones.

In practice, the materials used, as well as the contingent dimensions and shapes, may be any whatsoever according to the requirements and the state of the art.

The invention claimed is:

1. A switch (1) for low-voltage systems comprising an outer casing (2) containing for each pole at least one fixed contact (10) and at least one mobile contact (20), which can be coupled to/uncoupled from one another; and a mobile element (50), defined by a shaped body comprising at least one seat (25) for each pole of said switch (1), said seat (25) being designed to house at least one mobile contact (20) of a corresponding pole, wherein the switch comprises:

a control mechanism (60, 61) operatively connected to said mobile element (50) to enable its movement, said control mechanism (60, 61) comprising mechanical means supported by a structural part (70) connected to said outer casing (2); and supporting means constrained to said structural part (70) of said control mechanism (60, 61) and operatively connected to said mobile element (50) through hinge connection means to provide a centre of rotation for said mobile element (50), wherein said supporting means comprise a first supporting arm (80) and a second supporting arm (81), and wherein said supporting arms (80, 81) each comprise at least one first operative end (85) connected to said mobile element (50) through said hinge connection means and one second retention end (86) constrained to said structural part (70) of said control mechanism (60).

2. The switch (1) according to claim 1, wherein said control mechanism is of the energy-accumulation type.

3. The switch (1) according to claim 1, wherein said outer casing comprises a bottom (3), which is coupled to a lid (4) through geometrically mated coupling surfaces.

4. The switch (1) according to claim 1, wherein said mobile contacts (20) are mounted on a plurality of transverse rotation pins, aligned and arranged on housings (23) made on said side walls (28, 29) of said seats.

5. The switch (1) according to claim 1, wherein said supporting arms (80, 81) assume a three-lobed configuration.

6. The switch (1) according to claim 1, wherein said supporting arms (80, 81) are made of a single piece with said structural part (70) of said control mechanism (60).

7. The switch (1) according to claim 1, wherein said first operative end (85) of each supporting arm (80, 81) is inserted in one of said radial recesses (51, 52) of said mobile element (50) for being connected thereto through said hinge connection means.

8. The switch (1) according to claim 1, wherein said mobile element (50) is made of insulating material.

9. The switch (1) according to claim 1, wherein said mobile element (50) comprises a plurality of mutually adjacent seats (25), set between which are connecting parts (55) in a position corresponding to which said supporting means are operatively connected to said mobile element (50).

10. The switch (1) according to claim 9, wherein said mobile element (50) comprises a first circular connecting part (55*a*) and a second circular connecting part (55*b*), each located between two adjacent seats, said first part (55*a*) and said second part (55*b*) comprising a first radial recess (51) and a second radial recess (52), respectively.

11. The switch (1) according to claim 9, wherein each of said seats (25) is defined by a front wall (26), a rear wall (27) substantially opposite to said front wall (26), a first side wall (28) and a second side wall (29) substantially opposite to one another, said surfaces (26, 27, 28, 29) defining at least one first opening and one second opening, from which there come out, respectively, said mobile contacts (20) and means of electrical junction (47), designed to connect electrically said mobile contacts (20) to respective electrodes (22) of said switch (1).

12. The switch (1) according to claim 1, wherein said structural part (70) of said control mechanism (60) comprises at least one first side (71) and one second side (72), set between which are said mechanical means.

13. The switch (1) according to claim 12, wherein said supporting means are structurally constrained to said structural part (70) of said control mechanism (60) on an outer side of said first side (71) and of said second side (72).

14. The switch (1) according to claim 12, wherein at least one of said first supporting arm (80) or said second supporting arm (81) is structurally constrained to said structural part (70) of said control mechanism (60) through removable fixing means (73).

15. The switch (1) according to claim 1, wherein said hinge connection means comprise, for each supporting arm (80, 81), a rotation pin (110, 111), which is inserted in a first hole (84) made on said operative end (85) and in a second hole (84*a*) provided on the mobile element (50).

16. The switch (1) according to claim 15, wherein at least one of said first rotation pin (110) or said second rotation pin (111) comprises at least one first calibrated longitudinal portion (112) and at least one second threaded longitudinal portion (113), said first calibrated portion (112) being designed to couple with play with the internal surface of said first hole (83), said second threaded portion (113) being designed to be screwed within said second hole (84) of said mobile element (20).

17. The switch (1) according to claim 1, wherein said structural part (70) comprises fastening protrusions (78) for connection of said control mechanism (60) to said outer casing (2).

18. The switch (1) according to claim 17, wherein said control mechanism (60) is connected to said outer casing (2) through the use of a plurality of axial tie-rods (62).

19. The switch (1) according to claim 1, wherein said mechanical means (65) comprise a first connecting rod (91) and a second connecting rod (92) operatively connected to said mobile element (50) through a transverse driving pin (131).

20. The switch (1) according to claim 19, wherein said mobile element (50) is made of thermosetting resin or vinyl resins.

21. A single-pole or multi-pole switch (1) for low-voltage systems comprising:

an outer casing (2) containing for each pole at least one fixed contact (10) and at least one mobile contact (20), which can be coupled to/uncoupled from one another, said outer casing (2) comprising a bottom (3) that is coupled to a lid (4) through geometrically conjugate or mated coupling surfaces;

a mobile element (50) defined by a shaped body comprising a plurality of mutually adjacent seats (25), set between which are connecting parts (55), each comprising at least one radial recess (51, 52);

an energy-accumulation control mechanism (60), comprising mechanical means (65) supported by a structural part (70) connected to said outer casing (2), said mechanical means (65) comprising a first connecting rod (91) and a second connecting rod (92) connected to said mobile element (50) through a transverse pin (131); and supporting means comprising a first supporting arm (80) and a second supporting arm (81), each comprising at least one first operative end (85) connected to said mobile element (50) and one second retention end (86) connected to said structural part (70) of said control mechanism (60), each of said supporting arms (80, 81) being operatively connected to said mobile element (50) through a rotation pin (110, 111) and being constrained to said structural part (70) of said control mechanism (60) through removable fixing means (73), each of said operative ends (85) of said supporting arms (80, 81) being inserted in one of said radial recesses (51, 52) of said mobile element (50).

* * * * *